US006705265B2

(12) United States Patent
Tsukui et al.

(10) Patent No.: US 6,705,265 B2
(45) Date of Patent: Mar. 16, 2004

(54) FOUR-STROKE INTERNAL COMBUSTION ENGINE WITH VALVE RESTING MECHANISM

(75) Inventors: Takaaki Tsukui, Saitama (JP); Hiromi Sumi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/154,836

(22) Filed: May 28, 2002

(65) Prior Publication Data

US 2002/0195074 A1 Dec. 26, 2002

(30) Foreign Application Priority Data

Jun. 25, 2001 (JP) ..... 2001-191579

(51) Int. Cl.[7] ..... F01L 1/14

(52) U.S. Cl. ..... 123/90.52; 123/90.16; 123/90.48

(58) Field of Search ..... 123/90.15, 90.16, 123/90.17, 90.52, 90.48, 90.49, 90.53, 90.54, 90.55, 90.56, 90.57, 90.58, 90.59

(56) References Cited

U.S. PATENT DOCUMENTS 4,770,137 A 9/1988 Okabe et al.
6,223,706 B1 * 5/2001 Maas et al. ..... 123/90.16
6,237,041 B1 * 5/2001 Haas et al. ..... 123/90.16

FOREIGN PATENT DOCUMENTS

| | | |
|---|---|---|
| EP | 0 699 831 A | 3/1996 |
| EP | 1 020 619 A | 7/2000 |
| JP | 10184327 A | 7/1998 |

* cited by examiner

*Primary Examiner*—Thomas Denion
*Assistant Examiner*—Jaime Corrigan
(74) *Attorney, Agent, or Firm*—Birch, Stewart, Kolasch & Birch, LLP

(57) ABSTRACT

To provide a high performance four-stroke internal combustion engine wherein an increase in a side of a cylinder head is prevented and a valve resting mechanism is provided for a valve lifter. In a four-stroke internal combustion engine with a valve resting mechanism includes a valve lifter having a valve resting mechanism interposed between a valve motion cam and a stem of a poppet valve and a valve lifter spring is provided for biasing the valve lifter in a direction in which the valve lifter is normally held in contact with the valve motion cam. A slide pin holder is pressed against the valve lifter by a spring force of the valve lifter spring that is provided on the valve lifter while a shim portion having a predetermined thickness for controlling a relative positional relationship with the valve lifter is formed integrally with a valve lifter top wall. One of a plurality of predetermined valve lifters most suitable for the relative positional relationship between the slide pin holder and the valve lifter is selectively mounted to effect a tappet gap adjustment.

16 Claims, 10 Drawing Sheets

FOUR-STROKE INTERNAL COMBUSTION ENGINE WITH VALVE RESTING MECHANISM

BACKGROUND OF THE INVENTION

CROSS-REFERENCE TO RELATED APPLICATIONS

The present application claims priority under 35 USC 119 to Japanese Patent Application No. 2001-191579 filed on Jun. 25, 2001 the entire contents thereof is hereby incorporated by reference.

1. Field of the Invention

The present invention relates to a four-stroke internal combustion engine having a valve resting mechanism for a valve lifter. More particularly, to a four-stroke internal combustion engine which includes a relative positional adjustment structure between an intake or exhaust poppet valve stem and a valve lifter, or in other words, a gap adjustment structure.

2. Description of Background Art

A valve motion apparatus with a top end of a stem of an intake or exhaust poppet valve pressed down by a valve motion cam with a valve lifter interposed therebetween to drive the intake or exhaust poppet valve to open or close and the intake or exhaust poppet valve is rendered inoperative when necessary is disclosed in Japanese Patent Laid-Open No. 184327/1998 and is advantageous in that it is compact and involves a number of parts.

In the valve motion apparatus, in order to adjust the relative positional relationship between the stem of the intake or exhaust poppet valve and the valve lifter, a shim for gap adjustment is interposed between a top end of the stem of the intake or exhaust poppet valve and a top wall of the valve lifter.

In an OHC (overhead cam) type four-stroke internal combustion engine provided with a valve lifter, where a valve resting mechanism is provided for the valve lifter, the height in the direction of an axial line of the valve increases. This is likely to cause deterioration in incorporating the valve lifter in a vehicle because of an increase in the head height particularly in a high compression ratio four-stroke internal combustion engine having a small valve included angle.

Further, a valve lifter provided with a valve resting mechanism has a weight increased by the weight of the valve resting mechanism when compared with another valve lifter which is not provided with a valve resting mechanism. In addition, the weight of the shim is added to this construction. Consequently, the equivalent weight of the intake or exhaust poppet valve and so forth increases and the valve spring load increases. As a result, an increase in the friction loss of the valve motion apparatus cannot be avoided.

Furthermore, since a shim is interposed between a valve lifter of a complicated structure which has a built-in valve resting mechanism and a top portion of an intake or exhaust poppet valve, a mounting operation of the shim is cumbersome and it is difficult to perform the mounting operation readily in a short time.

SUMMARY AND OBJECTS OF THE INVENTION

The subject to be solved by the present invention is to overcome the difficulties described above.

According to the present invention, a four-stroke internal combustion engine with a valve resting mechanism is provided wherein a valve lifter having a valve resting mechanism is interposed between a valve motion cam and a stem of a poppet valve. A valve lifter spring is provided for biasing the valve lifter in a direction in which the valve lifter is normally held in contact with the valve motion cam. A slide pin holder presses against the valve lifter by a spring force of the valve lifter spring that is provided on the valve lifter while a shim portion having a different thickness for controlling a relative positional relationship with the valve lifter is formed integrally with a top wall of the valve lifter. One of a plurality of different valve lifters which is most suitable for the relative positional relationship between the slide pin holder and the valve lifter is selectively mounted to effect a tappet gap adjust.

Since the present invention is configured in such a manner as described above, even if a shim is not prepared separately, a tappet gap adjustment is performed.

Accordingly, the height of the cylinder head is reduced by an amount corresponding to the thickness of a shim, and a reduction in the overall size of the internal combustion engine can be achieved.

Further, since no shim is used, the equivalent weight of each of the intake and exhaust poppet valve systems is reduced, and the valve spring load is reduced. As a result, the friction loss of the valve motion apparatus decreases.

Furthermore, since there is no necessity to provide a shim for the valve lifter, the man-hours for assembly are reduced and the productivity is augmented.

Further, the present invention is configured in such a manner wherein a valve resting mechanism operates with certainty and is simple in structure is obtained.

Furthermore, where the present invention is configured in such a manner wherein since no shim is provided for the poppet valve side with a valve resting mechanism wherein the distance from the poppet valve to the cam is liable to become long if a valve resting mechanism is provided. Thus, an increase in the height of the cylinder head can be suppressed thereby to achieve a reduction of the overall size of the internal combustion engine. Meanwhile, a shim is provided for the poppet valve side which normally performs an opening and closing motion and wherein there is no possibility that the distance from the poppet valve for which no valve resting mechanism is provided and which normally performs an opening and closing motion to the cam that may increase so that a single type of valve lifter can be used. Consequently, inventory control of valve lifters can be simplified.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, an embodiment of the invention of the present application shown in FIGS. 1 to 11 is described.

Figure 1:
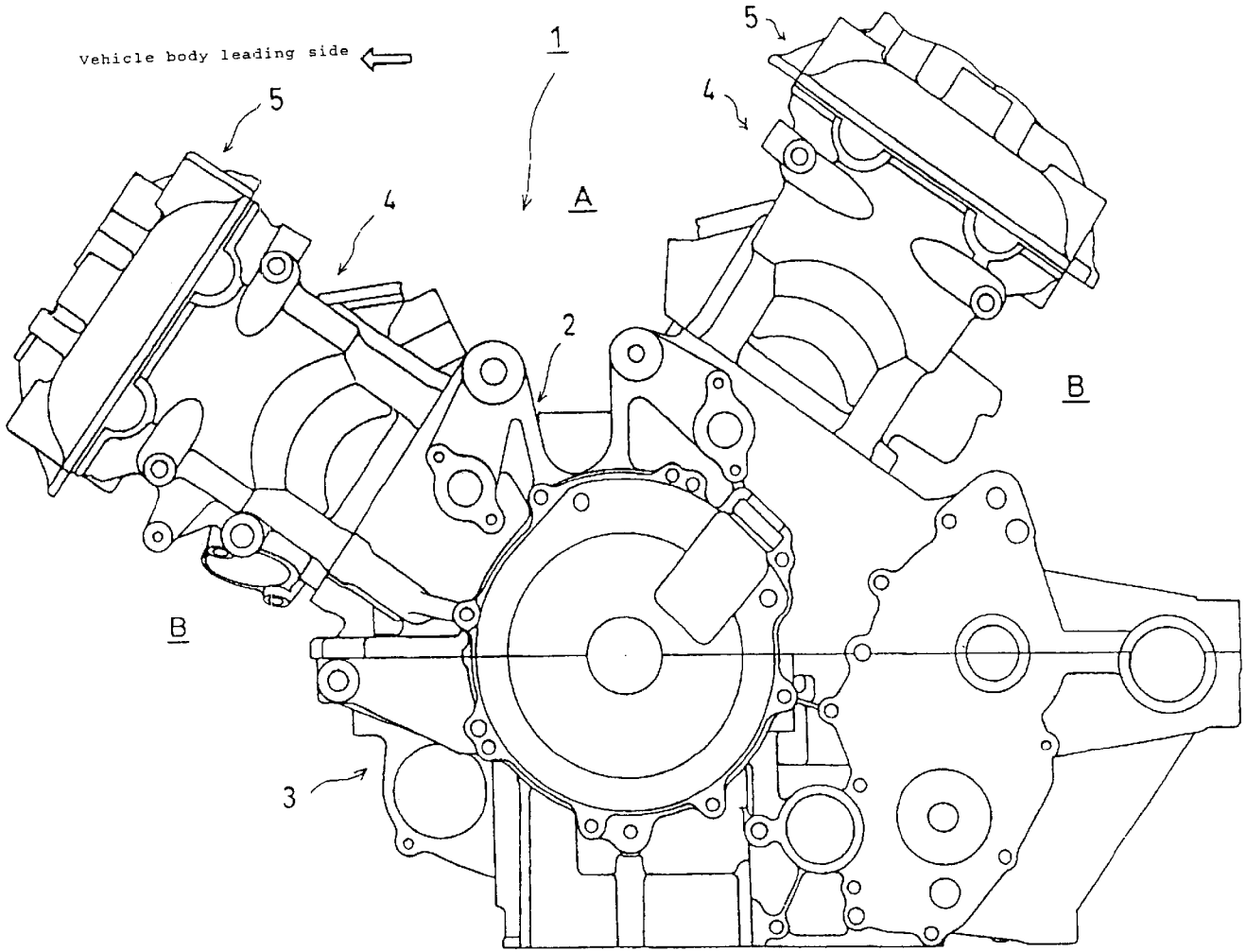
FIG. 1 is a schematic side elevational view of a four-stroke internal combustion engine with a valve resting mechanism according to the present invention.

An OHC type four-stroke internal combustion engine 1 incorporated in a motorcycle not shown is a lengthwise V-type internal combustion engine wherein, as shown in FIG. 1, a crankshaft (not shown) is directed in a vehicle widthwise direction and a cylinder on the vehicle body leading side and another cylinder on the vehicle body trailing side are disposed forwardly and backwardly defining an included angle of the right angle. A body of the OHC type four-stroke internal combustion engine 1 includes a cylinder block 2, a crankcase 3 mounted integrally on a lower face of the cylinder block 2, a set of two cylinder heads 4 integrally mounted at top ends of a vehicle body leading side cylinder bank and a vehicle body trailing side cylinder bank of the cylinder block 2, and a set of two head covers 5 for covering over the top portions of the cylinder heads 4.

Figure 2:
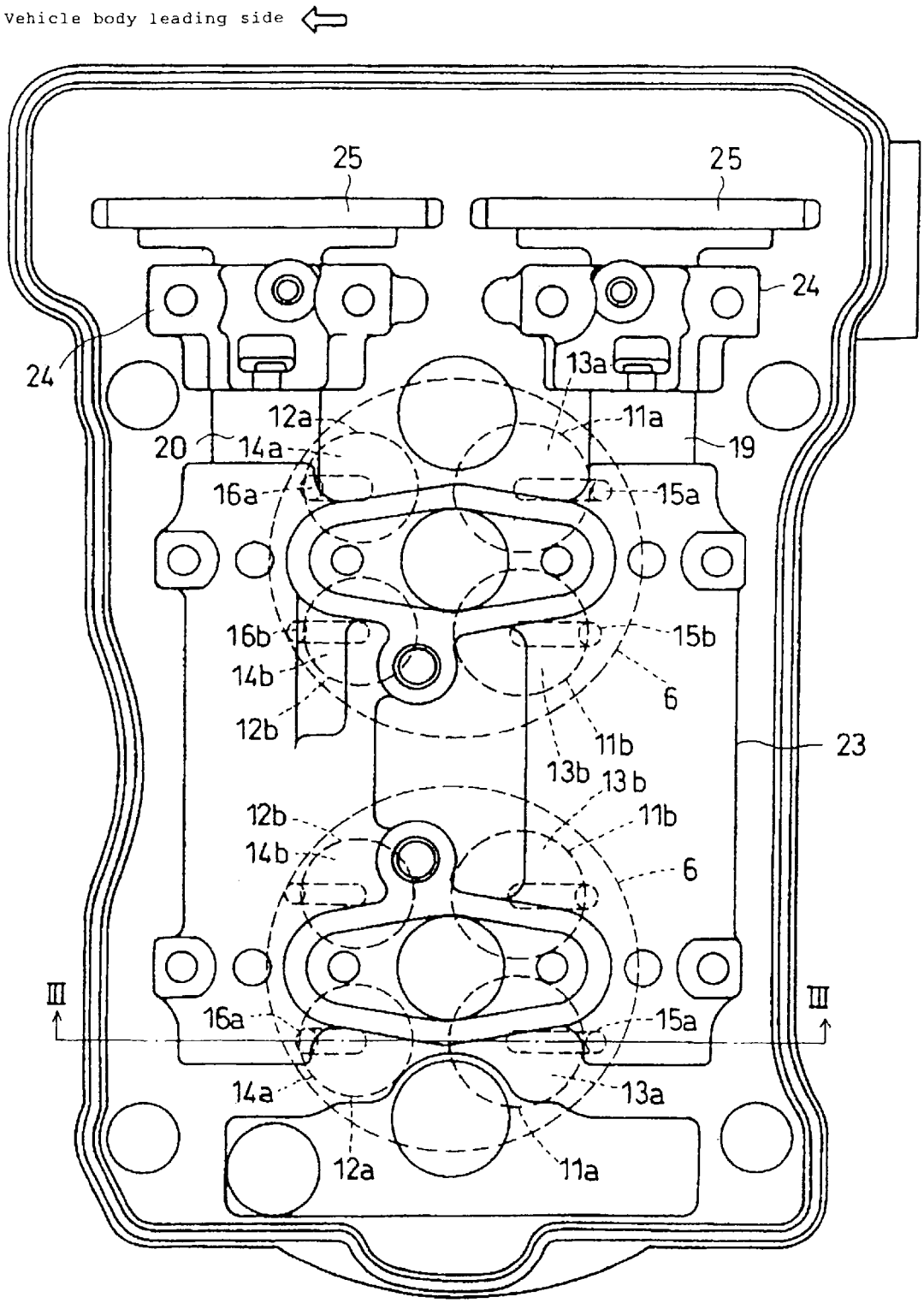
FIG. 2 is a top plan view of a front cylinder head with a front head cover removed.
Figure 3:
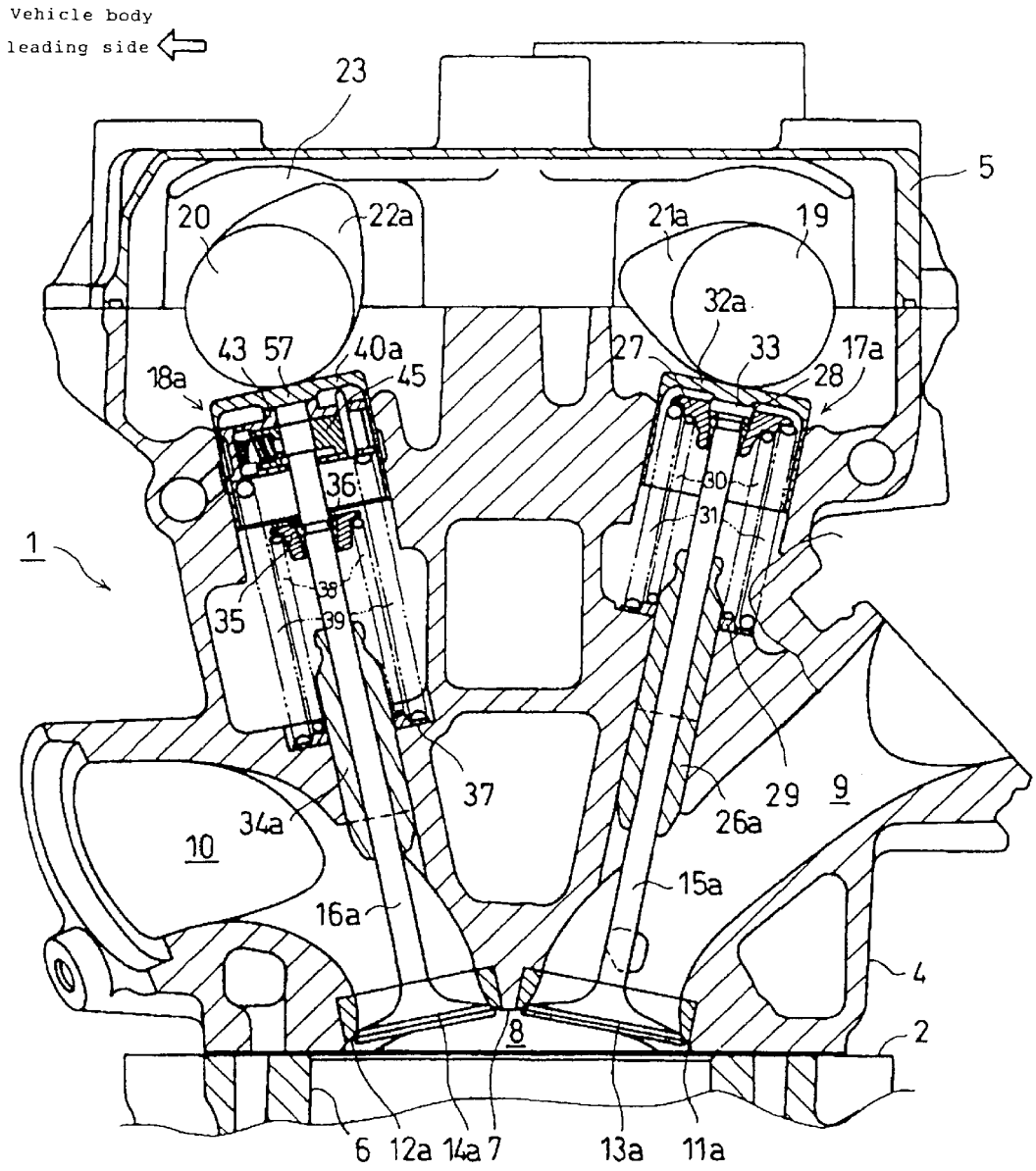
FIG. 3 is a vertical sectional side elevational view taken along line III—III of FIG. 2.
Figure 4:
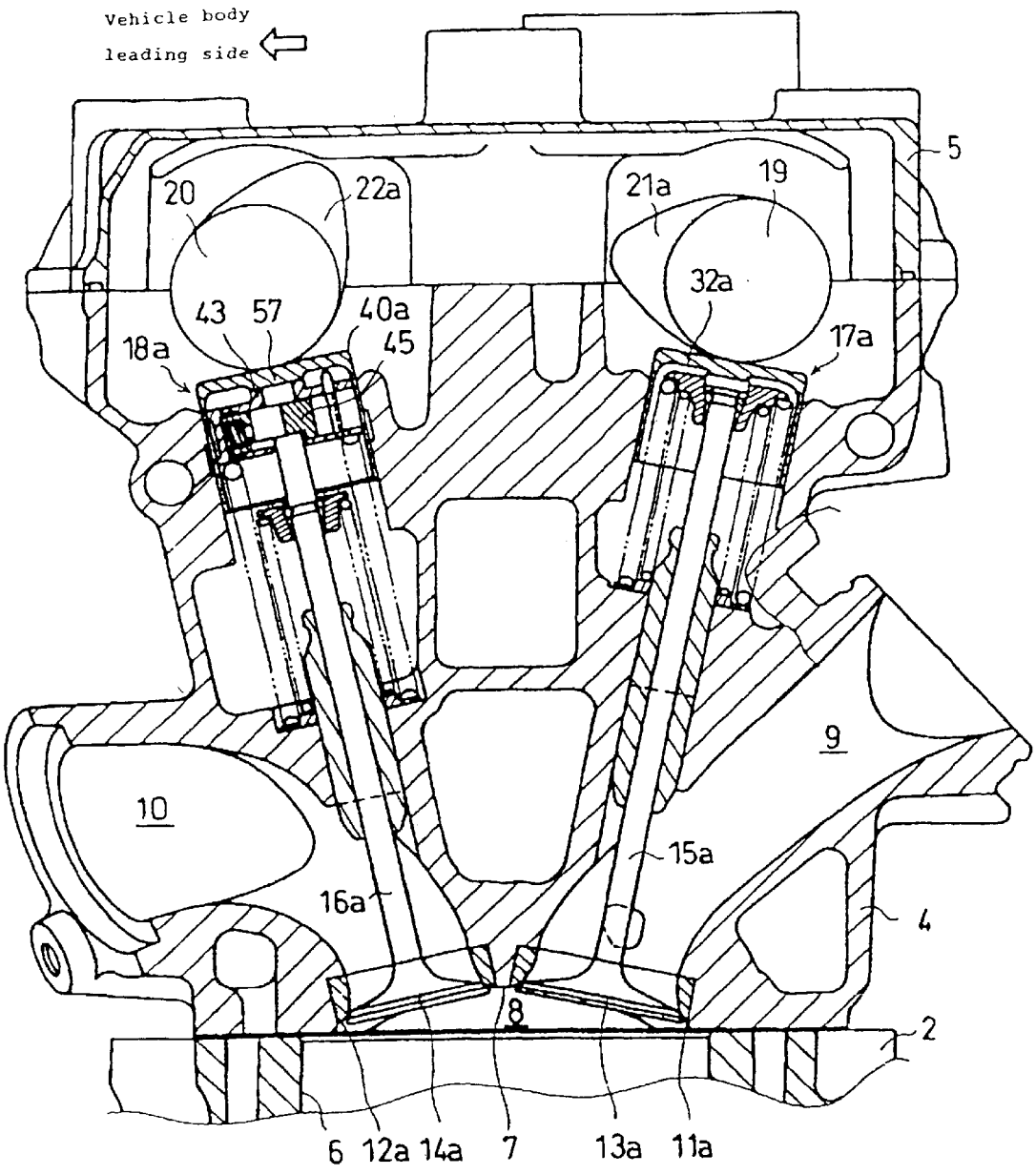
FIG. 4 is a vertical sectional side elevational view in a state wherein a valve rest state is cancelled in FIG. 3.
Figure 5:
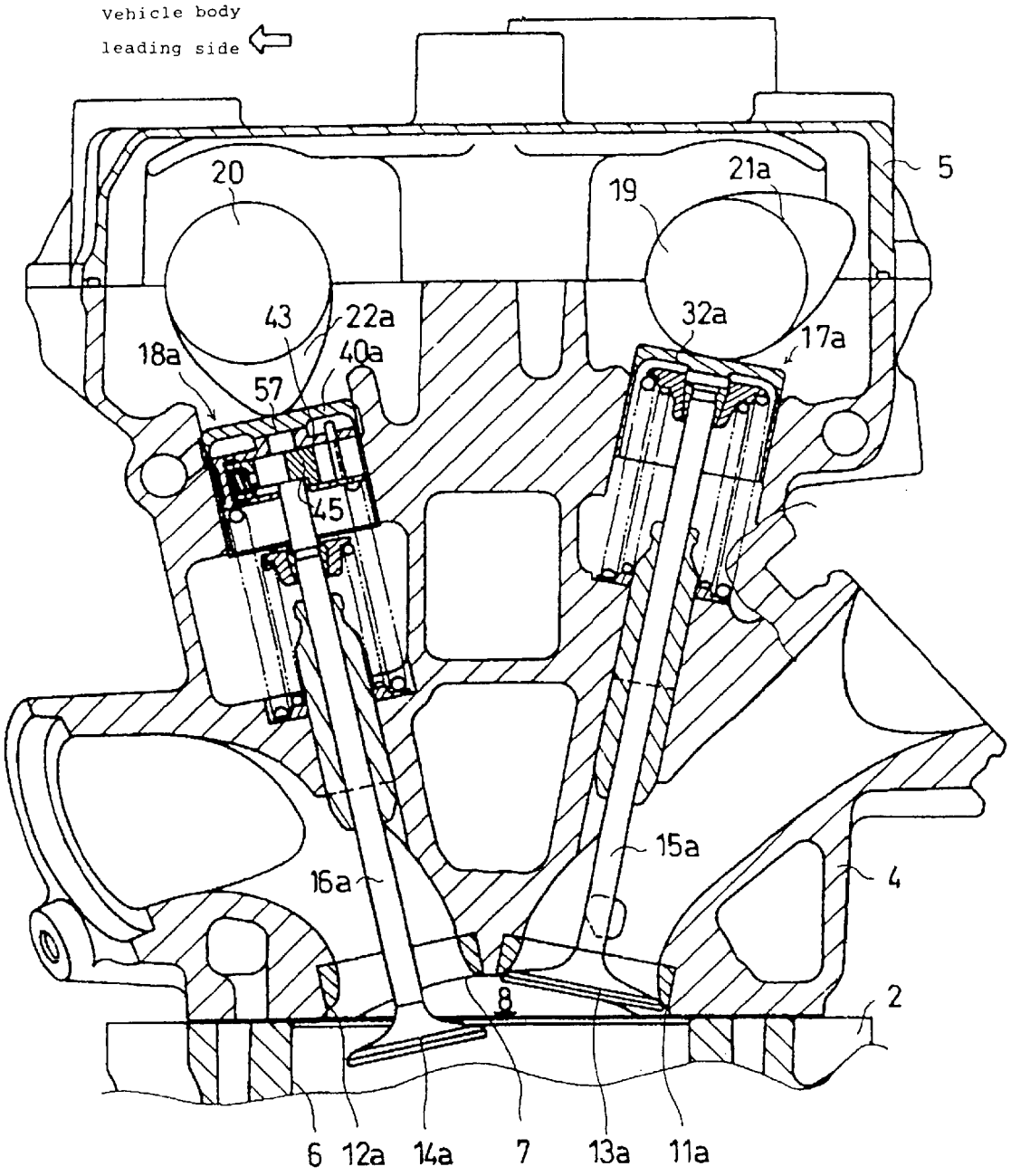
FIG. 5 is a vertical sectional side elevational view in a state wherein the valve rest state is cancelled and an exhaust valve is opened by a cam.

In each of the cylinder blocks 2 located at a leading portion and a trailing portion of the vehicle body, two cylinder holes 6 are juxtaposed in the vehicle body widthwise direction and are disposed at each of vehicle body leading and trailing positions as shown in FIG. 2 (only the cylinder block at the vehicle body leading portion is shown) thereby to form the four-cylinder OHC type four-stroke internal combustion engine 1. As shown in FIGS. 3 to 5, a pent-roof type recess 7 is formed at a location of a lower face of each of the cylinder heads 4 on the leading and trailing sides of the vehicle body corresponding to the cylinder hole 6. A combustion chamber 8 is defined by a piston (not shown) fitted in the cylinder hole 6, the cylinder hole 6 and the pent-roof type recess 7.

Further, in each of the vehicle body leading and trailing side cylinder banks of the V-type four-cylinder OHC type four-stroke internal combustion engine 1, a carburetor and an intake apparatus such as an intake chamber not shown are disposed on the cylinder included angle side (the side facing with a V-shaped space A between the leading and trailing side cylinder banks shown in FIG. 1, that is, a space defined by the cylinder bank on the vehicle body leading side and the cylinder bank on the vehicle body trailing side), and an exhaust pipe not shown is connected to the outer side (outer side B of the V-shaped space A between the leading and trailing side cylinder banks) of each of the cylinder banks on the vehicle body leading and trailing sides.

Further, as shown in FIGS. 3 to 5, an intake port 9 is formed at a vehicle body trailing side portion of the cylinder head 4 on the vehicle body leading side. The intake port 9 has two openings to the combustion chamber 8 to which two intake paths branched on the intake downstream side from a single upstream side intake path connecting to the intake apparatus described above are connected. Meanwhile, an exhaust port 10 is formed at a vehicle body leading side portion of the cylinder head 4 on the vehicle body leading side. The exhaust port 10 has two openings to the combustion chamber 8 to which two upstream side exhaust paths joining together on the exhaust downstream side into a single exhaust connected to an intake pipe not shown are connected. Further, as shown in FIGS. 2 and 6, an intake poppet valve 13*a*, an intake poppet valve 13*b* and a pair of exhaust poppet valves 14*a* and 14*b* for openably closing up the two intake openings 11*a* and 11*b* and the two exhaust openings 12*a* and 12*b*, respectively, are provided in the cylinder head 4.

Also in the vehicle body trailing side cylinder head 4, an intake port and an exhaust port whose arrangement is reverse in the forward and backward direction to that of the intake port 9 and the exhaust port 10 of the vehicle body leading side cylinder head 4 are formed. In particular, an intake port (not shown) having a similar shape to that of the intake port 9 at the vehicle body trailing side portion of the vehicle body leading side cylinder head 4 is formed in a vehicle body leading side portion of the vehicle body trailing side cylinder head 4. Further, an exhaust port (not shown) having a similar shape to that of the exhaust port 10 at the vehicle body leading side portion of the vehicle body leading side cylinder head 4 is formed at a vehicle body trailing side portion of the vehicle body trailing side cylinder head 4.

Figure 6:
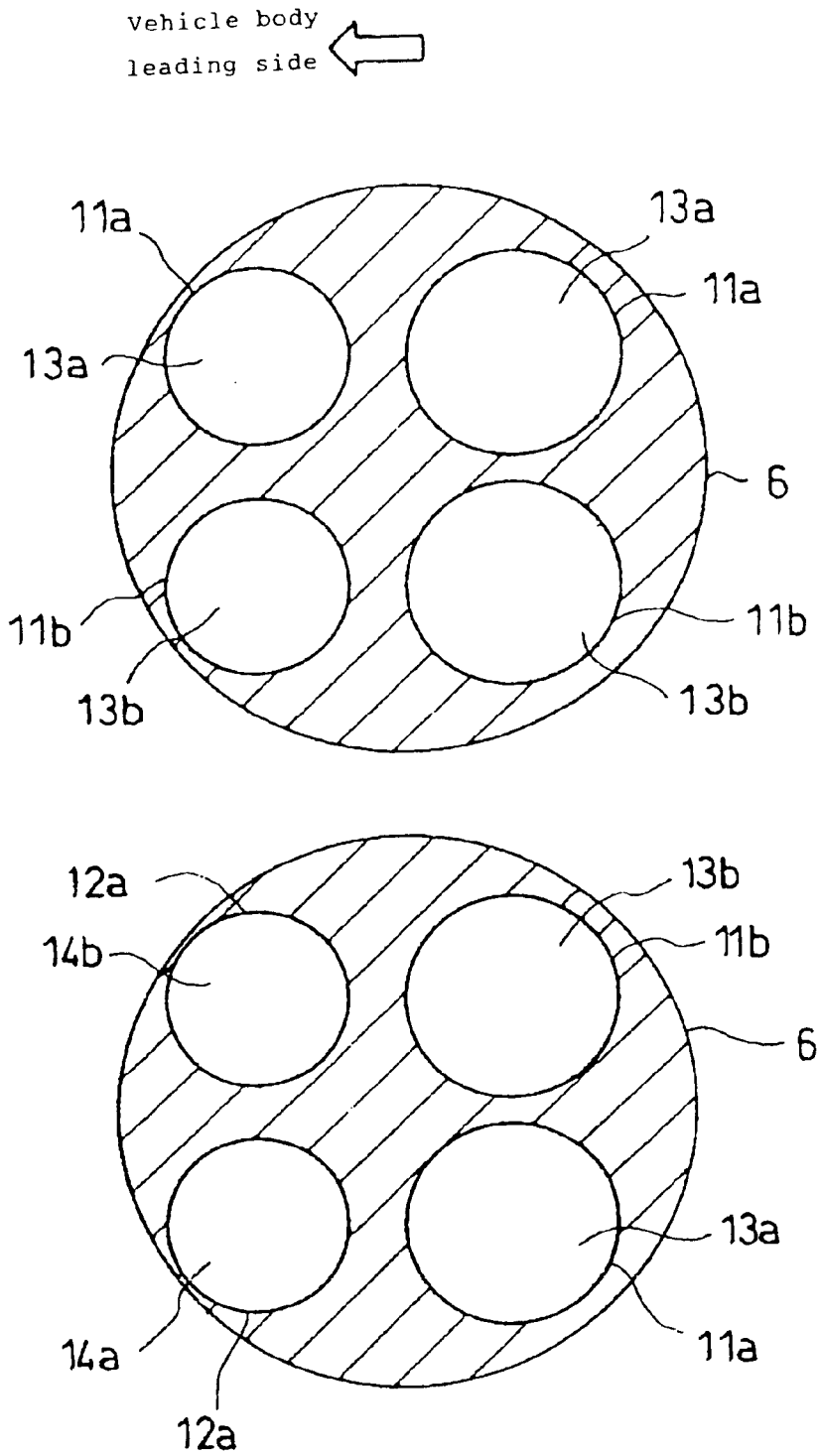
FIG. 6 is an explanatory view illustrating an arrangement state of cylinder holes and intake and exhaust poppet valves.

Furthermore, as shown in FIGS. 2 and 6, an intake poppet valve 13*a* for which a valve lifter 17 without a valve resting mechanism shown in FIGS. 3 to 5 is provided and which normally performs an opening and closing motion is provided for the intake opening 11*a* positioned on the vehicle body outer side corresponding to each of the cylinder holes 6. Meanwhile, an exhaust poppet valve 14*a* for which a valve lifter 18 with a valve resting mechanism shown in FIGS. 3 to 5 and which can stop its opening and closing motion is provided for the exhaust opening 12*a* positioned on the vehicle body outer side corresponding to each of the cylinder holes 6.

An intake poppet valve 13*b* is provided with a valve lifter 18 with a valve resting mechanism at the intake opening 11*b* positioned on the vehicle body inner side of each of the cylinder holes 6 contrary to the vehicle body outer side intake opening 11*a*. Further, an intake poppet valve (not shown in the vertical sectional views) for which provides a valve lifter 17 without a valve resting mechanism, is provided at the exhaust opening 12*b* positioned on the vehicle body inner side of each of the cylinder holes 6 contrary to the vehicle body outer side exhaust opening 12*a*.

In the following, description is given only of the intake poppet valve 13*a* with a valve lifter 17 without a valve resting mechanism provided at the vehicle body outer side intake opening 11*a* of the vehicle body leading side cylinder head 4 and the exhaust poppet valve 14*a* with a valve lifter 18 with a valve resting mechanism provided at the exhaust opening 12*a*.

An intake camshaft 19 is disposed on an extension line of a stem 15*a* and above the stem 15*a* of the intake poppet valve 13*a*, and an exhaust camshaft 20 is disposed on an extension line of a stem 16*a* and above the stem 16*a* of the exhaust poppet valve 14*a*. The intake camshaft 19 and the exhaust camshaft 20 are each mounted for rotation on the cylinder head 4 by a camshaft holder 23 positioned at a mid-portion in the vehicle body widthwise direction and another camshaft holder 24 is positioned on the right side in the vehicle body widthwise direction as shown in FIG. 2. An intake cam 21*a* of the intake camshaft 19 and an exhaust cam 22*a* of the exhaust camshaft 20 for each of the cylinder holes 6 are held in contact with top faces of a valve lifter 17*a* without a valve resting mechanism of the intake poppet valve 13*a* and a valve lifter 18*a* with a valve resting mechanism of the exhaust poppet valve 14*a*, respectively. A driven sprocket wheel 25 is mounted integrally at the vehicle body right end of each of the intake camshaft 19 and the exhaust camshaft 20. An endless chain not shown extends between a driving sprocket wheel (not shown) integral with a crankshaft not shown and the driven sprocket wheel 25. When the OHC type four-stroke internal combustion engine 1 is placed into an operative state, an intake cam 21*a* and an exhaust cam 22*a* are driven to rotate in the same direction at a speed equal to one half the speed of rotation of the crankshaft.

In the intake poppet valve 13*a* for which the valve lifter 17*a* without a valve resting mechanism is provided, a valve guide tube 26*a* for guiding and supporting the stem 15*a* of the intake poppet valve 13*a* for sliding movement is formed to be longer by a length equal to that of a valve resting mechanism. A retainer 27 is fitted at a top portion of the stem 15*a* of the intake poppet valve 13*a* and is coupled integrally to the top end of the stem 15*a* by means of a cotter pin 28. Two inner and outer valve springs 30 and 31 are interposed in parallel to each other between a valve spring receiving piece 29 in the proximity of an upper portion of a valve guide tube 26 and the retainer 27 such that the intake poppet valve 13*a* is normally biased in a direction in which it closes the intake opening 11*a* of the intake port 9 by the spring force of the valve springs 30 and 31. A shim 33 is fitted in a central hole of the retainer 27 between the top end of the stem 15*a* of the intake poppet valve 13*a* and a top wall 32*a* of the valve lifter 17*a* without a valve resting mechanism so that the top wall 32*a* of the valve lifter 17*a* without a valve resting mechanism is biased in a direction in which it closely contacts with the intake cam 21*a* by the spring force of the valve springs 30 and 31.

Meanwhile, in the exhaust poppet valve 14*a* for which the valve lifter 18*a* with a valve resting mechanism is provided, a valve guide tube 34*a* for guiding and supporting the stem 16*a* of the exhaust poppet valve 14*a* for sliding movement is formed longer by a length equal to that of a valve resting mechanism. A retainer 35 is fitted not at a top end but at an upper portion of the stem 16*a* of the exhaust poppet valve 14*a* and is coupled integrally to the upper portion of the stem 16*a* by means of a cotter pin 36. A valve spring 38 is interposed between a valve spring receiving piece 37 in the proximity of the upper portion of the valve guide tube 34*a* and the retainer 35 while another valve spring 39 having a greater coil diameter than the valve spring 38 is interposed between the valve spring receiving piece 37 and the valve lifter 18*a* with a valve resting mechanism. Consequently, the exhaust poppet valve 14*a* is normally biased in a direction in which it normally closes up the exhaust opening 12*a* of the exhaust port 10 by the spring force of the valve spring 38 while a top wall 40*a* of the valve lifter 18*a* with a valve resting mechanism is biased in a direction in which it closely contacts with the exhaust cam 22 by the spring force of the valve spring 39.

At a central portion of the top wall 40*a* of the valve lifter 18*a* with a valve resting mechanism, an increased thickness portion 57 which serves as a shim is formed with a thickness a little greater than that of an outer peripheral portion of the top wall 40*a*. Several valve lifters 18*a* with a valve resting mechanism are prepared wherein the increased thickness shim portion 57 is different in thickness.

Now, a valve resting mechanism of the valve lifter 18*a* with a valve resting mechanism is described.

Figure 7:
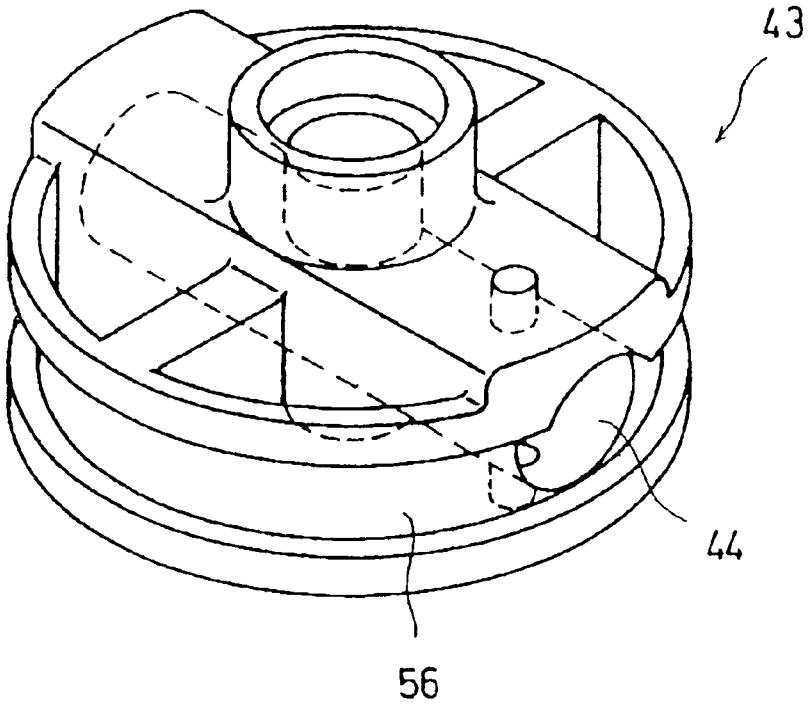
FIG. 7 is a perspective view of a slide pin holder.
Figure 8:
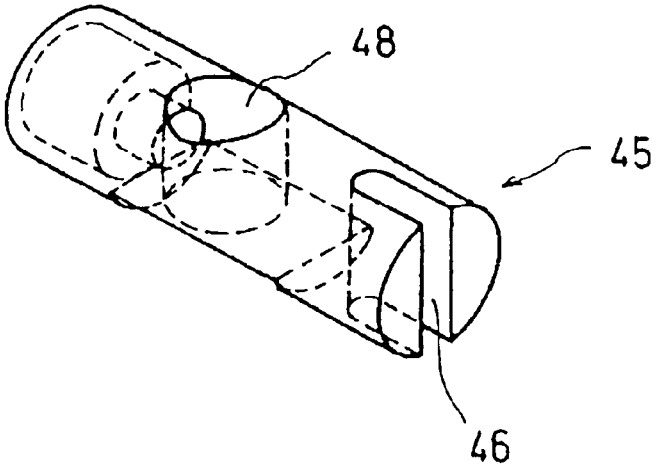
FIG. 8 is a perspective view of a slide pin.
Figure 9:
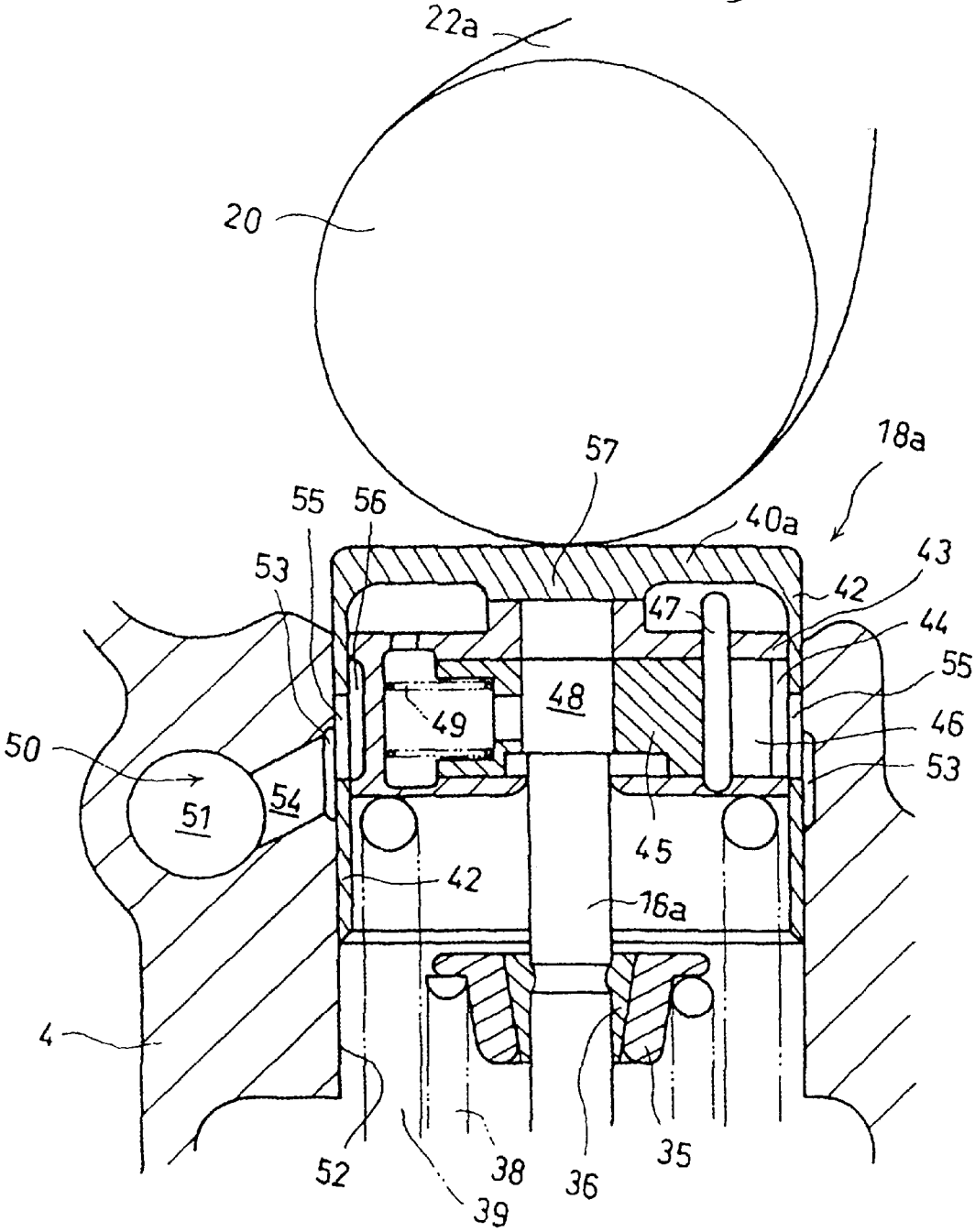
FIG. 9 is an enlarged vertical sectional side elevational view of essential part illustrating a valve resting state of a valve lifter with a valve resting mechanism.
Figure 10:
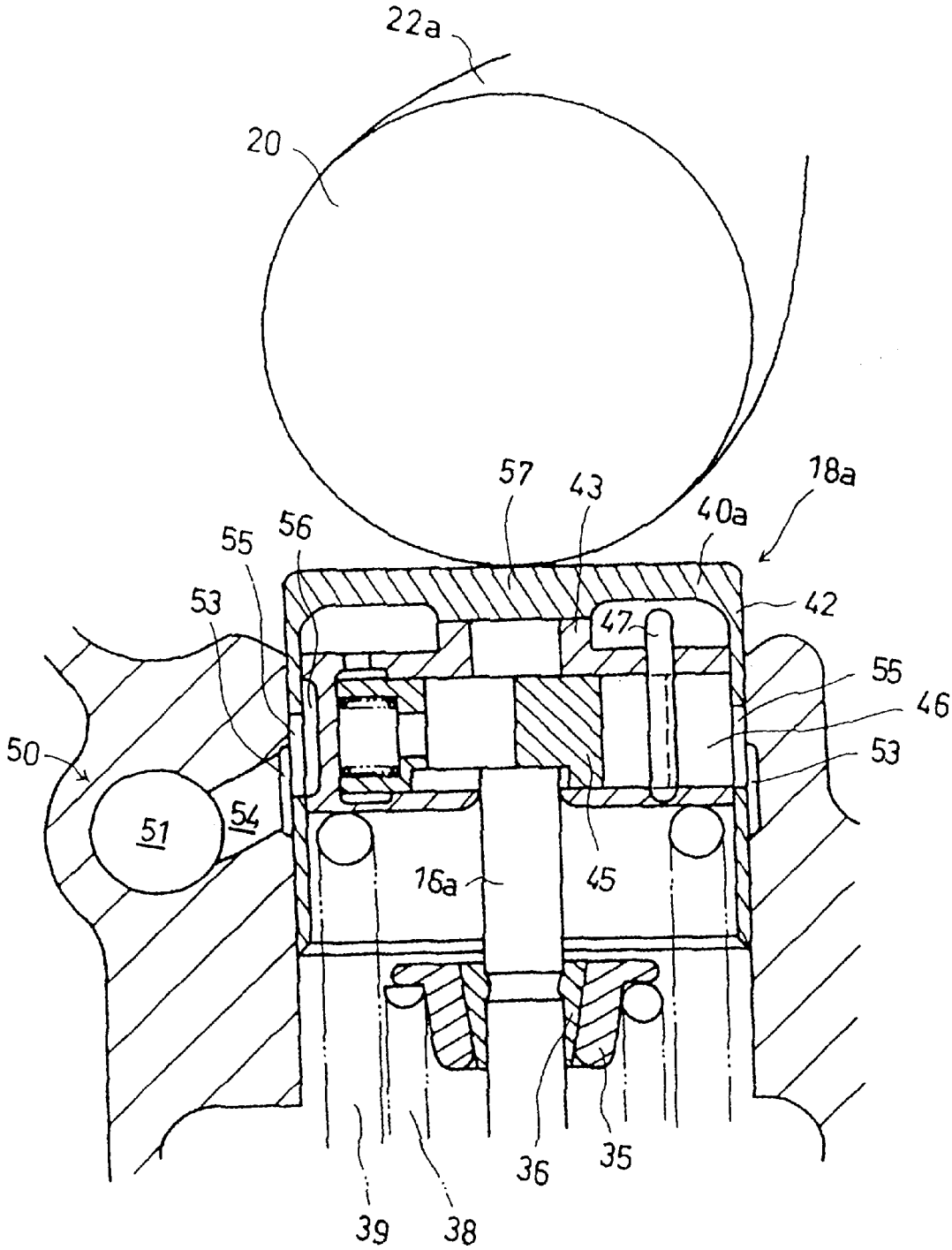
FIG. 10 is an enlarged vertical sectional side elevational view of essential part illustrating a valve resting cancelled state of the valve lifter with a valve resting mechanism.
Figure 11:
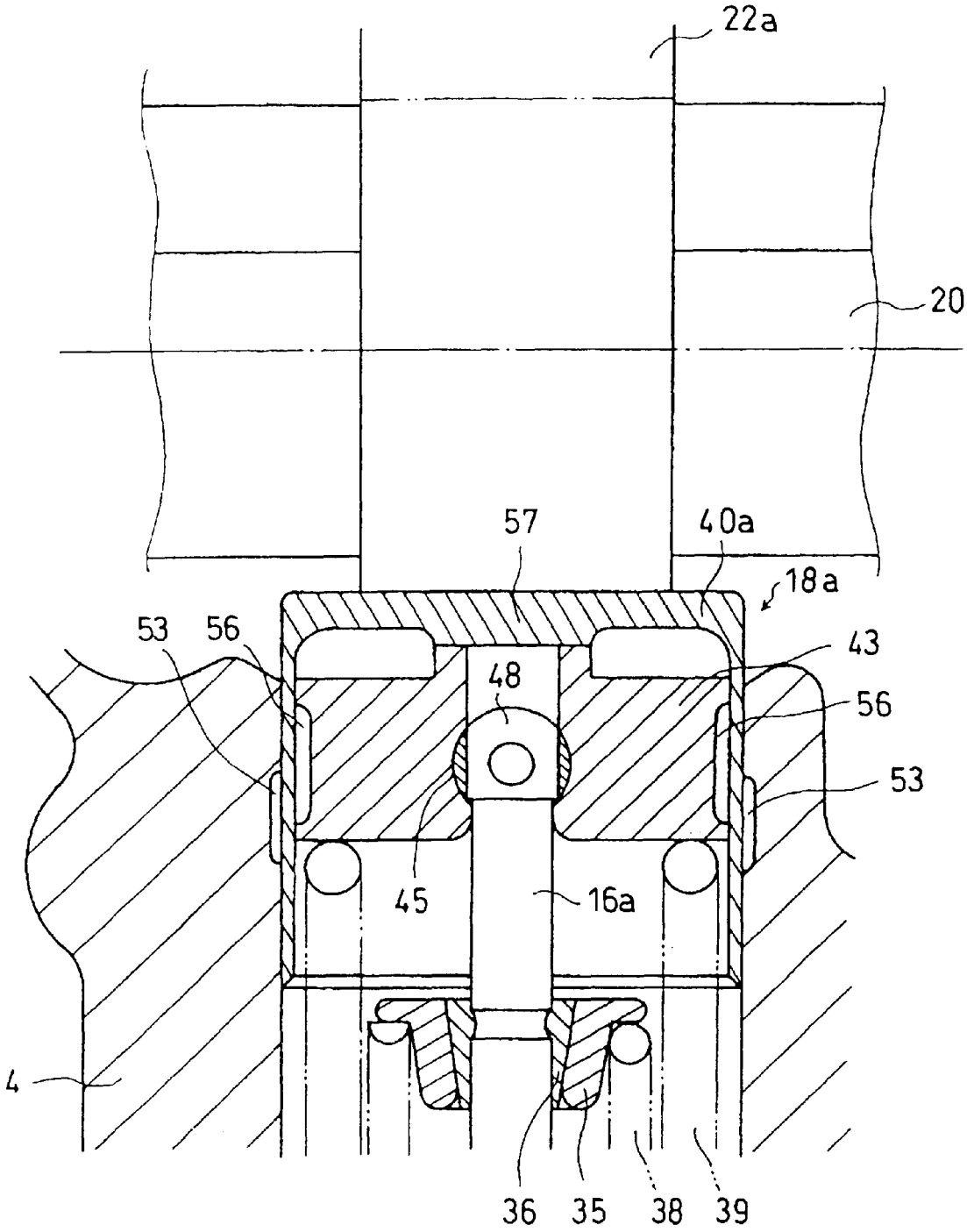
FIG. 11 is a sectional view taken along line XI—XI of FIG. 9.

As shown in FIGS. 9 and 10, the valve resting mechanism includes a slide pin holder 43 shown in FIG. 7 which is fitted within a cylindrical circumferential wall 42 of the valve lifter 18*a* with a valve resting mechanism such that it can move along the sliding direction (upward or downward direction) of the valve lifter 18*a* with a valve resting mechanism, a slide pin 45 shown in FIG. 8 which is fitted for sliding movement in a pin hole 44 of the slide pin holder 43 such that it can be removably engaged with the stem 16*a* of the exhaust poppet valve 14*a*, a guide pin 47 extending through the slide pin holder 43 and capable of loosely fitting in a guide groove 46 formed at one end portion of the slide pin 45, a pin spring 49 interposed between the other end of the slide pin 45 and a bottom portion of the pin hole 44 of the slide pin holder 43 for biasing the bottom portion of the guide groove 46 of the slide pin 45 in a direction in which it contacts with the guide pin 47, and a hydraulic driving apparatus 50 for pressing the slide pin 45 towards the pin spring 49 against a spring of a stem through-hole 48.

In a state shown in FIG. 9 wherein oil pressure is not supplied to an oil pressure path 51 on one end side of the pin hole 44 by the hydraulic driving apparatus 50 and therefore the bottom portion of the guide groove 46 of the slide pin 45 is held in contact with the guide pin 47 by the pin spring 49, the stem through-hole 48 is formed in the slide pin 45 and positioned in the direction of an extension line of the stem 16*a* of the exhaust poppet valve 14*a* such that the stem 16*a* of the exhaust poppet valve 14*a* can be slidably moved in the stem through-hole 48 of the slide pin 45.

Further, in the hydraulic driving apparatus 50, as shown in FIGS. 9 and 10, the oil pressure path 51 which is connected through a control valve (not shown) to an exhaust port of a hydraulic pump not shown provided in the OHC type four-stroke internal combustion engine 1 is formed in the cylinder head 4. A circumferential recessed groove 53 directed in a circumferential direction is formed in a lifter guide hole 52 of the valve lifter 18 with a valve resting mechanism provided on the cylinder head 4. The oil pressure path 51 and the circumferential recessed groove 53 are in communication with each other by a communication hole 54.

Further, a side hole 55 is formed in the cylindrical circumferential wall 42 of the valve lifter 18 with a valve resting mechanism for communicating with the circumferential recessed groove 53 of the lifter guide hole 52 at whichever position the valve lifter 18*a* with a valve resting mechanism is positioned when the valve lifter 18*a* with a valve resting mechanism is moved upwardly or downwardly by the exhaust cam 22*a*. As shown in FIG. 7, a circumferential recessed groove 56 which is in communication with the side hole 55 is formed on an outer peripheral face of the slide pin holder 43. When oil pressure is supplied into the oil pressure path 51, the oil pressure is introduced into an opening of the pin hole 44 from the oil pressure path 51 through the communication hole 54, circumferential recessed groove 53, side hole 55 and circumferential recessed groove 56. The pressure of the oil pressure overcomes the spring force of the pin spring 49 to move the slide pin 45 toward the pin spring 49 (refer to FIGS. 4, 5 and 10) until the stem 16*a* of the exhaust poppet valve 14*a* is arrested by the slide pin 45. A valve lifter 18*b* with a valve resting mechanism is provided in the intake opening 11*b* positioned on the vehicle body inner side, conversely to the intake opening 11*a* on the vehicle body outer side. Meanwhile, a valve lifter 17*b* without a valve resting mechanism is provided at the exhaust opening 12*b* positioned on the vehicle body inner side.

Since the embodiment shown in FIGS. 1 to 11 is configured in such a manner as described above, in a state wherein the OHC type four-stroke internal combustion engine 1 operates at a low speed or with a low load and no oil pressure is supplied into the oil pressure path 51, the slide pin 45 is biased and moved in a direction in which it moves away from the pin spring 49 by the spring force of the pin spring 49 until the bottom portion of the guide groove 46 is arrested by the guide pin 47 in a state wherein the stem through-hole 48 is positioned immediately above the stem 15*b* or 16*a* as shown in FIGS. 3 and 9.

In this low speed-low load operation state, the top portions of the stems 15*b* and 16*a* of the intake poppet valve 13*b* and the exhaust poppet valve 14*a* can extend through and be freely slidably moved relative to the stem through-hole 48 of the slide pin 45. Consequently, even if the valve lifters 18*a* and 18*b* with a valve resting mechanism are driven to move upwardly and downwardly by the intake cam 21*a* and the exhaust cam 22*a*, the intake poppet valve 13*b* and the exhaust poppet valve 14*a* are held in a closed state and are set in a valve resting state, respectively.

However, if the OHC type four-stroke internal combustion engine 1 is operated at a high speed or with a high load and oil pressure is supplied into the oil pressure path 51, then the oil pressure is introduced from the oil pressure path 51 into the pin hole 44 through the communication hole 54, circumferential recessed groove 53, side hole 55 and circumferential recessed groove 56. Consequently, the pressure of the oil pressure at an entrance portion of the pin hole 44 overcomes the spring force of the pin spring 49 to drive the slide pin 45 to move in a direction in which it approaches the pin spring 49 until the stems 15*b* and 16*a* of the intake poppet valve 13*b* and the exhaust poppet valve 14*a* are each arrested by a bottom cutaway portion 45*a* of the slide pin 45 as shown in FIGS. 4, 5 and 10. Consequently, as shown in FIG. 5, the intake poppet valve 13*b* and the exhaust poppet valve 14*a* are opened and closed.

Further, since the valve resting mechanism is built in each of the valve lifters 18*a* and 18*b*, the valve lifters 18*a* and 18*b* with a valve resting mechanism are likely to be formed with an increased upward and downward dimension. However, since the shim 33 is not provided for each of the valve lifters 18*a* and 18*b* with a valve resting mechanism, the height of the valve lifters 18*a* and 18*b* with a valve resting mechanism is reduced as much. Thus, even if it is tried to decrease the valve included angle of the intake poppet valves 13 and the exhaust poppet valves 14 in order to reduce the combustion chamber 8 to raise the compression ratio, an increase in the height of the cylinder heads 4 is prevented, and an increase in the size of the OHC type four-stroke internal combustion engine 1 is prevented.

Further, since the shim 33 is not provided on any of the valve lifters 18*a* and 18*b* with a valve resting mechanism, the equivalent weight of each of the intake poppet valve 13*b* and the exhaust poppet valve 14*a* is reduced, and the spring load of the valve spring 31 is reduced. Consequently, the power loss in opening and closing of the intake poppet valve 13*b* and the exhaust poppet valve 14*a* is reduced.

Furthermore, since the amount of work for assembling the shim 33 to each of the valve lifters 18*a* and 18*b* with a valve resting mechanism is unnecessary, the man-hours for assembly are reduced and the productivity is augmented.

In addition, since the valve resting mechanism is not provided on each of the valve lifters 17*a* and 17*b* without a valve resting mechanism, even if the shim 33 is provided to the valve lifters, the height of the valve lifters 17*a* and 17*b* without a valve resting mechanism in the upward and downward direction can be made substantially equal to that of the valve lifters 18*a* and 18*b* with a valve resting mechanism. Consequently, one kind of valve guide tube can be used for the valve guide tubes 34 of the valve lifters 17*a* and 17*b* without a valve resting mechanism, and therefore, the inventory control of the valve lifters 17*a* and 17*b* without a valve resting mechanism can be simplified with an anticipated reduction in the cost.

Further, in a low speed or low load operation state wherein the exhaust poppet valve 14*a* and the intake poppet valve 13*b* are controlled to a rest state by the valve lifters 18*a* and 18*b* with a valve resting mechanism, the intake poppet valve 13*a* and the exhaust poppet valve 14*b* which normally perform an opening and closing motion are positioned in a diagonal direction as shown in FIGS. 2 and 6. Therefore, a swirl is generated in the air fuel mixture in the combustion chamber 8, and firing is performed with certainty. Consequently, the generation of unburned gas is suppressed and fuel cost is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A four-stroke internal combustion engine with a valve resting mechanism comprising:

a valve lifter having a top wall and a side wall;

a valve resting mechanism, said valve resting mechanism being interposed between a valve motion cam and a stem of a poppet valve;

a valve lifter spring for biasing said valve lifter in a direction in which said valve lifter is normally held in contact with said valve motion cam;

a slide pin holder, said slide pin holder being pressed against said valve lifter by said valve lifter spring; and a shim portion having a predetermined thickness for controlling a relative positional relationship with said valve lifter, said shim portion being formed integrally in one piece with said top wall of said valve lifter, wherein a plurality of different valve lifters is provided for being selectively mounted to effect tappet gap adjustment, each of said different valve lifters including said shim portion having a different thickness to affect the relative positional relationship between said slide pin holder and said valve lifter.

2. The four-stroke internal combustion engine with a valve resting mechanism according to claim 1, wherein said valve resting mechanism includes said slide pin holder fitted with said valve lifter for sliding movement in opening and closing directions of said poppet valve, a slide pin fitted for sliding movement with said slide pin holder for removably engaging with said stem of said poppet valve, and slide pin driving means for driving said slide pin to move into or out of engagement with said stem of said poppet valve.

3. The four-stroke internal combustion engine with a valve resting mechanism according to claim 2, and further including biasing means for normally biasing said slide pin to be out of engagement with the stem of the poppet valve.

4. The four-stroke internal combustion engine with a valve resting mechanism according to claim 3, and further including a passageway for selectively supplying a fluid to imparting movement to said slide pin to move against the biasing means for moving said slide pin into engagement with the stem of the poppet valve.

5. The four-stroke internal combustion engine with a valve resting mechanism according to claim 3, and further including a guide pin for engaging said slide pin when said slide pin is out of engagement with the stem of the poppet valve.

6. The four-stroke internal combustion engine with a valve resting mechanism according to claim 2, wherein said slide pin is out of engagement with the stem of the poppet valve during a low-speed operational state of the engine.

7. The four-stroke internal combustion engine with a valve resting mechanism according to claim 1, wherein at least one of intake and exhaust valves per one cylinder of said four-stroke internal combustion engine is composed of a plurality of valves, said plurality of valves include a valve or valves for which a valve resting mechanism is provided, and a valve or valves for which no valve resting mechanism is provided, and said shim portion is used for tappet gap adjustment of said valve or valves for which no valve resting mechanism is provided.

8. The four-stroke internal combustion engine with a valve resting mechanism according to claim 1, wherein said shim portion is formed by an increased thickness portion of said top wall of said valve lifter, said increased thickness portion being located at a center of said top wall of said valve lifter.

9. A four-stroke internal combustion engine with a valve resting mechanism comprising:

a valve lifter having a top wall and a side wall;

a valve resting mechanism, said valve resting mechanism being interposed between a valve motion cam and a stem of a poppet valve;

a valve lifter biasing means for biasing said valve lifter in a direction wherein said valve lifter is normally held in contact with said valve motion cam;

a slide pin holder, said slide pin holder being pressed against said valve lifter by said valve lifter biasing means; and a shim portion having a predetermined thickness for controlling a relative positional relationship with said valve lifter, said shim portion being formed integrally in one piece with said top wall of said valve lifter, wherein a plurality of different valve lifters is provided for being selectively mounted to effect a tappet gap adjustment, each of said different valve lifters including said shim portion having a different thickness to affect the relative positional relationship between said slide pin holder and said valve lifter.

10. The four-stroke internal combustion engine with a valve resting mechanism according to claim 9, wherein said valve resting mechanism includes said slide pin holder fitted with said valve lifter for sliding movement in opening and closing directions of said poppet valve, a slide pin fitted for sliding movement with said slide pin holder for selectively engaging with said stem of said poppet valve, and slide pin driving means for driving said slide pin to move into or out of engagement with said stem of said poppet valve.

11. The four-stroke internal combustion engine with a valve resting mechanism according to claim 10, and further including biasing means for normally biasing said slide pin to be out of engagement with the stem of the poppet valve.

12. The four-stroke internal combustion engine with a valve resting mechanism according to claim 11, and further including a passageway for selectively supplying a fluid to imparting movement to said slide pin to move against the biasing means for moving said slide pin into engagement with the stem of the poppet valve.

13. The four-stroke internal combustion engine with a valve resting mechanism according to claim 11, and further including a guide pin for engaging said slide pin when said slide pin is out of engagement with the stem of the poppet valve.

14. The four-stroke internal combustion engine with a valve resting mechanism according to claim 10, wherein said slide pin is out of engagement with the stem of the poppet valve during a low-speed operational state of the engine.

15. The four-stroke internal combustion engine with a valve resting mechanism according to claim 9, wherein at least one of intake and exhaust valves per one cylinder of said four-stroke internal combustion engine is composed of a plurality of valves, said plurality of valves include a valve or valves for which a valve resting mechanism is provided, and a valve or valves for which no valve resting mechanism is provided, and said shim portion is used for tappet gap adjustment of said valve or valves for which no valve resting mechanism is provided.

16. The four-stroke internal combustion engine with a valve resting mechanism according to claim 9, wherein said shim portion is formed by an increased thickness portion of said top wall of said valve lifter, said increased thickness portion being located at a center of said top wall of said valve lifter.

* * * * *